US006106323A

United States Patent [19]

Elisei et al.

[11] Patent Number: 6,106,323

[45] Date of Patent: Aug. 22, 2000

[54] END CAP FOR INSULATION PIERCING CONNECTORS

[75] Inventors: Davide Elisei, Dijon; Thierry Rousseau, Chamboeuf, both of France

[73] Assignee: The Whitaker Corporation, Wilmington, Del.

[21] Appl. No.: 09/336,775

[22] Filed: Jun. 21, 1999

[30] Foreign Application Priority Data

Jul. 2, 1998 [EP] European Pat. Off. ..... 98401663

[51] Int. Cl.[7] ..... H01R 4/24

[52] U.S. Cl. ..... 439/395; 439/411; 439/412; 439/519; 439/892

[58] Field of Search ..... 439/395, 411, 439/412, 814, 519, 892

[56] References Cited

U.S. PATENT DOCUMENTS 3,380,014 4/1968 Schenker et al. ..... 439/412

5,015,198 5/1991 Delin ..... 439/411

FOREIGN PATENT DOCUMENTS 0 007 706-B1 2/1980 European Pat. Off. .

2 634 070-A1 1/1990 France .

*Primary Examiner*—Gary F. Paumen

*Assistant Examiner*—Tho D. Ta

*Attorney, Agent, or Firm*—Michael Aronoff

[57] ABSTRACT

An insulation piercing connector assembly is provided with a sealing cap mountable over the end of a cable and subsequently insertable between clamping jaws of the connector. The assembled sealing cap and end cable are clamped prior to termination by retaining plates for easier handling and more reliable termination. Insulation piercing contacts of the connector pierce through the body of the sealing cap and insulation layer of the cable during termination. The sealing cap arrangement enables the cable to be inserted between the clamping jaws from a side thereof which is particularly useful in confined spaces.

7 Claims, 4 Drawing Sheets

END CAP FOR INSULATION PIERCING CONNECTORS

BACKGROUND OF THE INVENTION

1. Field of the Invention

This invention relates to an insulation piercing connector assembly with a sealing cap for covering an end of a cable positioned in the insulation piercing connector.

2. Description of the Prior Art

Insulation piercing connectors for tapping power from one cable to another typically comprise a pair of insulated clamping housings with insulation piercing blades mounted therein, the housings having a first set of teeth on one side thereof interconnected with a second set of teeth on another side thereof, each side for connection to a cable. Piercing of an outer insulation layer of the cables is effected by bolting the connector clamping halves together. Such connectors are widely used and for example shown in European patent 0 007 706, or in U.S. Pat. No. 5,015,198, or FR 2 634 070. In the latter two prior references, the clamping insulation piercing connector is provided on one side thereof with an end cap that can be filled with sealing gel and which is received over an end of a cable. In the latter application, the connector is used for tapping off power from a continuous main conductor to a branch conductor (that commences at the connector). In order to prevent ingress of fluid into the conductor strands of the branch cable, and also to prevent exposure of live bare conductors, it is typical to provide a cap over the end of branch cables. Typically, as in FR 2 634 070, the end cap is fixed to the connector and the end of the cable is inserted into the connector until abutment against the end cap. Subsequently, the clamping halves are bolted together for the contacts to pierce through the cable outer insulation and connect with the inner conducting strands thereof. By positioning the end cap securely on the connector prior to insertion of the cable into the end cap, an easy and secure means of assembling live cables to the connector is provided, and once assembled the end cap cannot be lost or removed. The cable however needs to be inserted in the cable direction between the connector jaws and into the end cap. Powerline cables are fairly stiff, and therefore providing enough slack in the end cable for insertion into the connector (particularly if the connector is fitted along another cable to be tapped) requires a fairly long section of end cable. The latter thus means, for example, that a larger hole is required where the cable is buried, increasing the costs of installing and maintaining power lines.

SUMMARY OF THE INVENTION

It is an object of this invention to provide a sealed clamping connector that is secure and that reduces the need for slack in cables to be interconnected thereby.

It would be desirable to provide a secure and easy means of connecting insulated cables to insulation piercing clamping connectors that is more versatile. In particular, it would be advantageous to enable clamping of cables with different configurations, without requiring a different connector for each configuration. For example, it would be advantageous to provide a secure and reliable insulation piercing clamping connector that enables two cable ends to be connected together, the cable ends protected from the environment and preventing exposure of live bare conductor ends.

Objects of this invention have been achieved by an electrical connector assembly comprising an electrical insulation piercing connector having a pair of clamping halves or jaws, at least one of the jaws comprising at least one insulation piercing terminal having insulation piercing contacts for piercing through an outer insulation layer of an electrical cable and contacting inner conducting strands thereof, the assembly further comprising an end sealing cap insertable over an end of the cable wherein the end sealing cap is adapted to be received between the clamping halves or jaws such that the insulation piercing contacts pierce through the end sealing cap during clamping connection to the cable. Advantageously therefore, the end sealing cap can be pre-mounted to the cable end which may be inserted laterally (i.e. approximately orthogonally to the direction of the cable) between the clamping jaws. The jaws are subsequently clamped tightly together whereby the insulation piercing contacts pierce through the end sealing cap and insulation of the cable for contacting the inner contacting strands. The seal is thus securely held to the connector when the cable is terminated, and provides safe operation by pre-assembly to the cable end thereby covering exposed conductors at the cut-off end of the cable, and further enabling the sealed cable end to be inserted between the clamping halves of the connector from the side rather than in the cable direction such that little cable slack is required.

The connector assembly may further comprise one or more pre-clamping retention members mountable on at least one of the clamping halves, for retaining the end sealing cap and end cable to the connector prior to termination of the cable to the connector. The end sealing cap and cable end can thus be inserted between the jaws of the connector and held by the one or more retention devices thereto prior to clamping the jaws together. The connector assembly can thus be easily handled for example to position the other side of the clamping halves over another cable, whilst ensuring correct positioning of the cables in the connector for correct termination thereof. The retention member and end sealing cap may be further provided with interengaging shoulders that co-operate to locate and position the clamping jaw with respect to the end of the cable, thereby ensuring correct positioning during termination. The retention members may be movably mounted to the connector, for example slidable in a direction approximately perpendicular to the cable direction and towards on of the clamping jaws. The retention member provisionally clamps the cable one of the clamping jaws of the connector. Ratchet teeth may be provided along one or more sides or edges of the retention member for co-operation with complementary teeth in a guide portion attached to the clamping jaw for receiving and guiding the retention member, the interengaging teeth serving to maintain the retention member in the provisional clamping position.

The end sealing cap may be made of an elastomeric material with a substantially cylindrical body defining a cavity adapted to snugly or elastically fit over a length of the cable end greater than the length of the connector (with regards to the cable direction). Two or more end sealing caps may be provided as a single moulding whereby the end sealing caps are breakably interconnected together such that different cable diameters can be accommodated. Prior to utilisation, the end caps may for example be removably attached to the connector.

Further advantageous aspects of the invention are set forth in the claims, or will be apparent from the following description and drawings.

DETAILED DESCRIPTION OF THE PREFERRED EMBODIMENT

Figure 1:
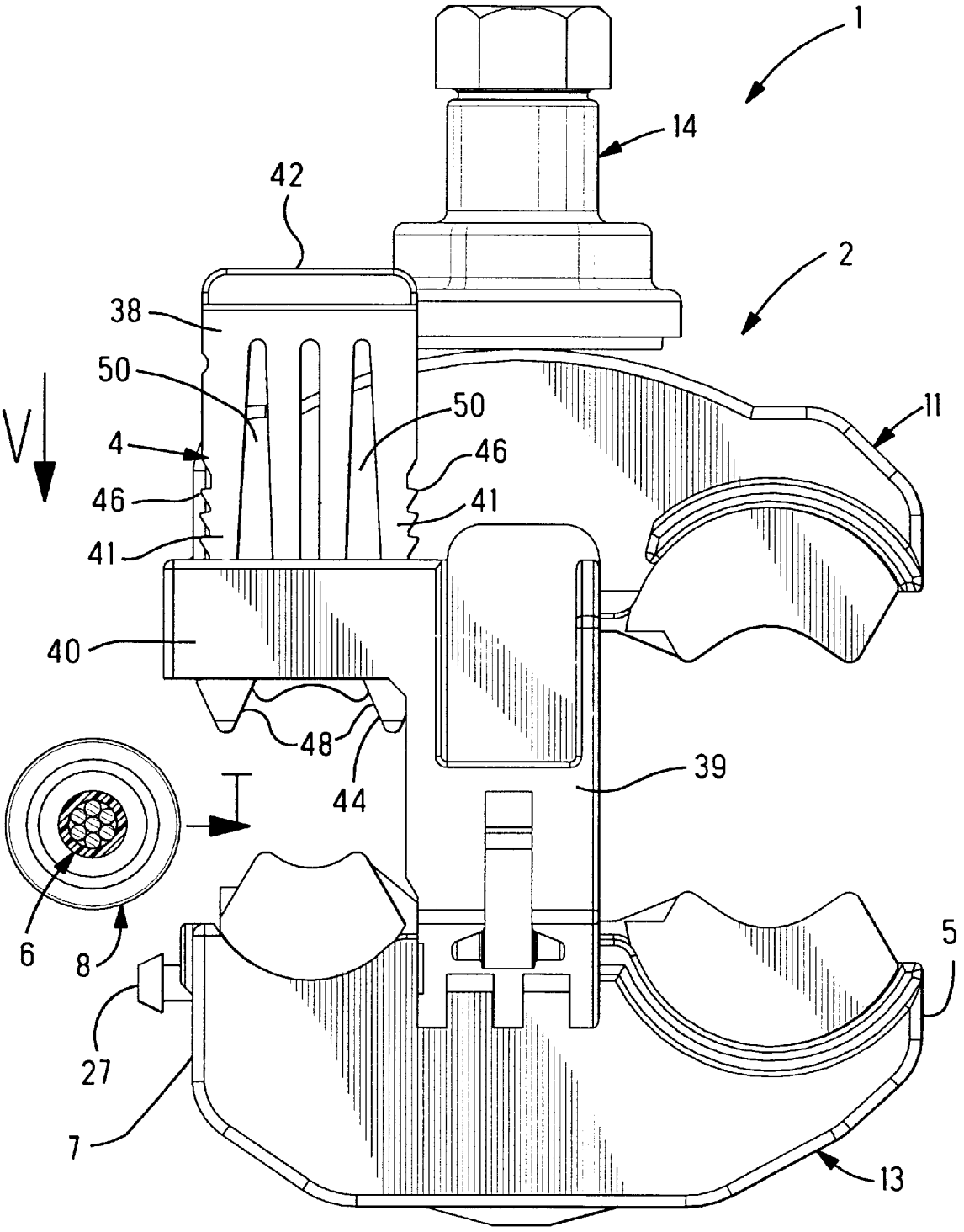
FIG. 1 is a plan end view of an insulation piercing connector assembly about to receive an end-cable over which is mounted an end sealing cap.

Referring to the figures, a connector assembly 1 comprises an insulation piercing contact (IPC) connector 2 for interconnecting a first through-cable or end-cable (not shown) to an end-cable 6. The through-cable may for example be a main cable, off which electrical power is tapped to a branch, tap, or distribution cable 6 (hereinafter "end-cable"). Alternatively, the IPC connector may interconnect two end-cables thereby acting as a splice. Both cables are comprised of inner conducting strands surrounded by an outer insulating layer. The IPC connector 2 is provided with a pair of opposed clamping halves 11, 13, each comprising insulation piercing contacts for piercing through the cable outer insulation layers and contacting the inner conducting strands. Such connectors are generally well known in the art, and may for example be provided with clamping halves comprising an insulative housing and contacts according to EP 0 007 706, FR 2 634 070, or U.S. Pat. No. 5,015,198. The clamping halves 11, 13 are clamped together by means of a bolt 14 centrally positioned between cable receiving sides 5, 7 of the connector. As insulation piercing connectors are well known in the art, the IPC connector 2 will not be described in further detail except for the features relating to the improvements thereof.

The assembly further comprises an end sealing cap 8 mountable over the end of the end-cable 6, and a pre-termination retention device 4 mounted on the connector 2 for holding the end cable and cap to the connector prior to electrical termination, as will be described in more detail further on. The end cap 8 can be made of an elastomeric material such as a silicon based rubber, or a flexible plastic material that is injection moulded, and comprises a substantially cylindrical cavity 16 extending therethrough for snugly receiving the cable end 6 therein through a cable receiving or open end 18 until abutment with an opposed closed end 20 (see FIGS. 2 and 5). Proximate the open end 18 the cavity 16 may be provided with a plurality of circumferential sealing ribs 22 for providing a water tight seal against the cable 6. For caps made from a supple elastic material such as rubber, the inner diameter of the cylindrical cavity 16 may be slightly smaller than the outer diameter of the cable such that elastic compression of the sealing ribs 22 against the cable provides a tight seal. The elasticity of a rubber sealing cap also enables a single sealing cap to be utilised for cables of slightly different diameters.

Figure 2:
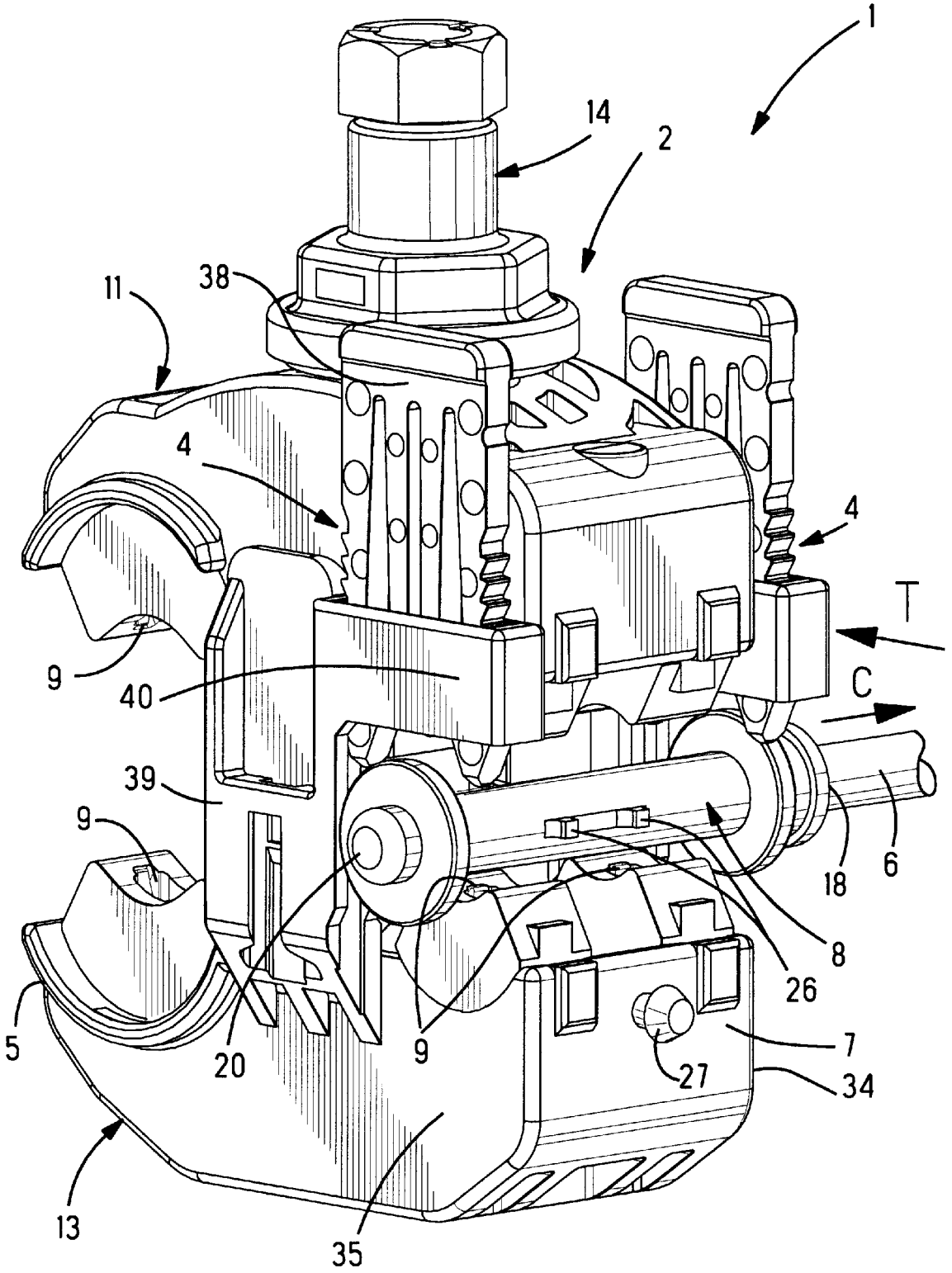
FIG. 2 is a perspective view of the connector assembly of FIG. 1, with the end cable inserted between clamping halves or jaws of the connector.
Figure 5:
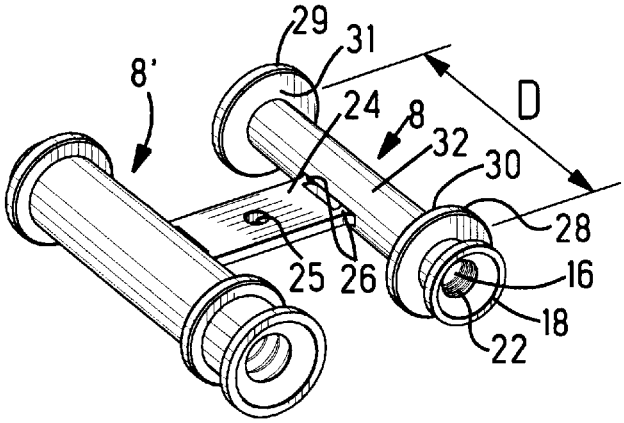
FIG. 5 is a perspective view of different size end sealing caps moulded together.

A plurality of end sealing caps 8, 8' as shown in FIG. 5, may be provided with the connector assembly 1 for use with different cable sizes, whereby to provide an economical connector assembly the different end sealing caps 8, 8' may be moulded together such that they are integrally attached via bridging portions 24 and connected to the bridging portions 24 via thin breakable portions 26 such that the desired end cap may be broken off for use in the assembly, as shown for example in FIG. 2. The sealing caps may be fixable provisionally to the connector by means of the hole 25 received in the stud 27 on the connector.

The end cap may also be made of a less resilient material such as a plastic, and for example partially filled with a sealing gel or grease that prevents the ingress of moisture by filling any hollow spaces within the cavity 16 when the cap is mounted on the cable.

The end sealing cap is further provided with retaining walls 28, 29 proximate the or open end 18 and closed end 20 respectively, the retaining walls 28, 29 in the form of circular flanges defining retention shoulders 30, 31 extending radially from the elongate cylindrical body portion 32 of the sealing cap. The retention shoulders 30, 31 are in this embodiment spaced apart by a distance (D) that is greater than the length (L) of the IPC connector 2 (in the direction (C) of the cable 6) between opposed end faces 34, 35 of the connector. The retaining walls 28, 29 thus serve to locate and position the cable end assembled to the sealing cap 8 with respect to the connector, and in particular with respect to the insulation piercing contact teeth 9 thereof.

Prior to termination the end sealing cap 8 is thus slipped over the end of the cable 6 until abutment of the severed end of the cable against the closed end 20 of the sealing cap, and subsequently inserted between the clamping halves or jaws 11, 13 on one side (for example the second side 7 as shown in FIG. 2) of the connector 2. Insertion of the assembled sealing cap 8 and cable 6 is effected in a direction approximately perpendicular to the cable direction (C) as indicated by the orthogonal direction (T) shown in FIG. 1. Lateral insertion of the cable end 6 between the jaws 11, 13 whilst ensuring effective sealing and enhanced operator safety, enables the cable to be terminated in confined spaces where there is little available cable slack (in comparison to conventional sealed IPC connections where the cable is inserted in the cable direction (C) a sealing cap protruding beyond an end of the connector).

Figure 3:
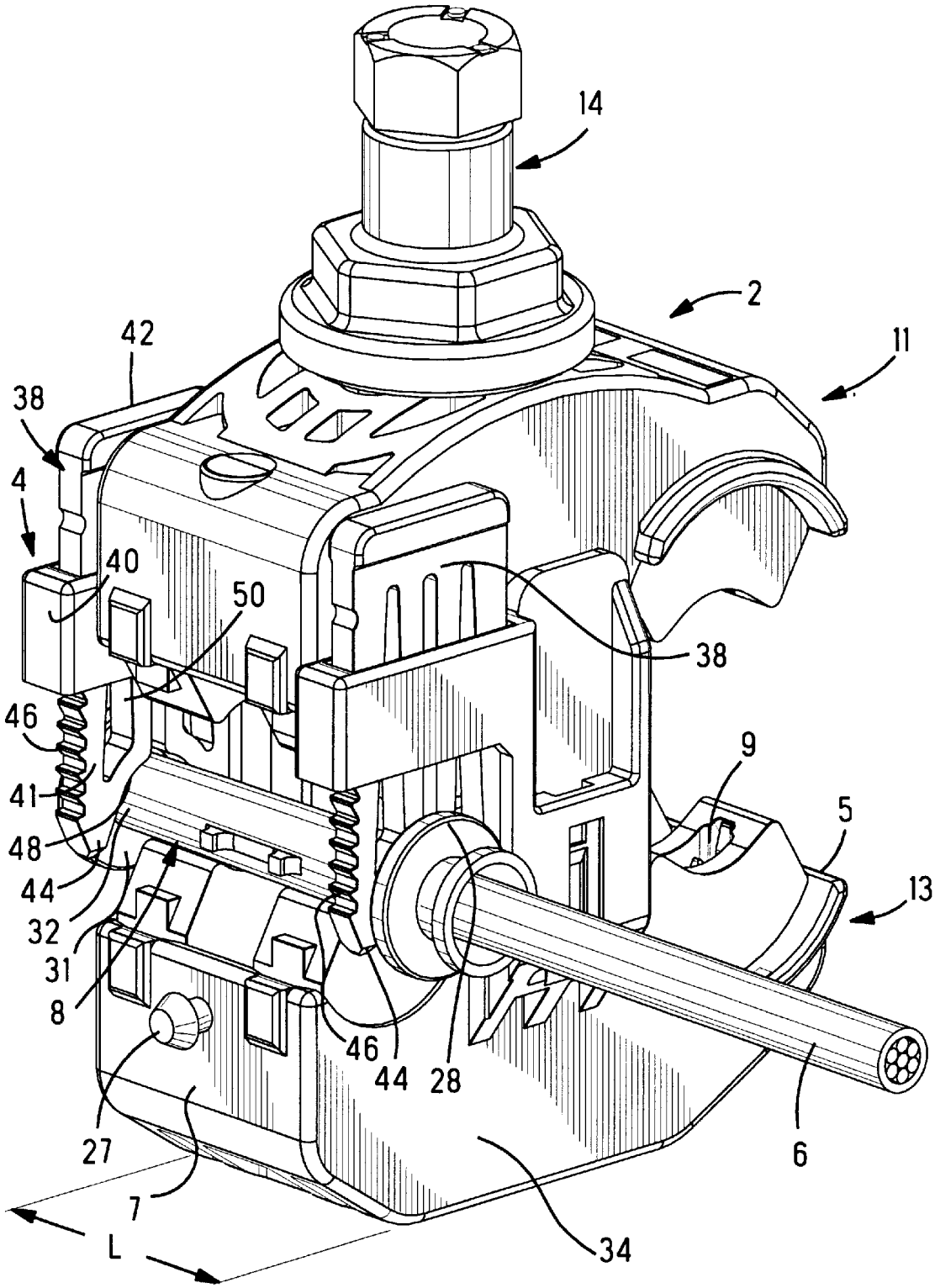
FIG. 3 is a perspective view of the assembly of FIG. 2 with pre-termination retention members of the assembly moved to the retaining position holding the end cable to the connector.
Figure 4:
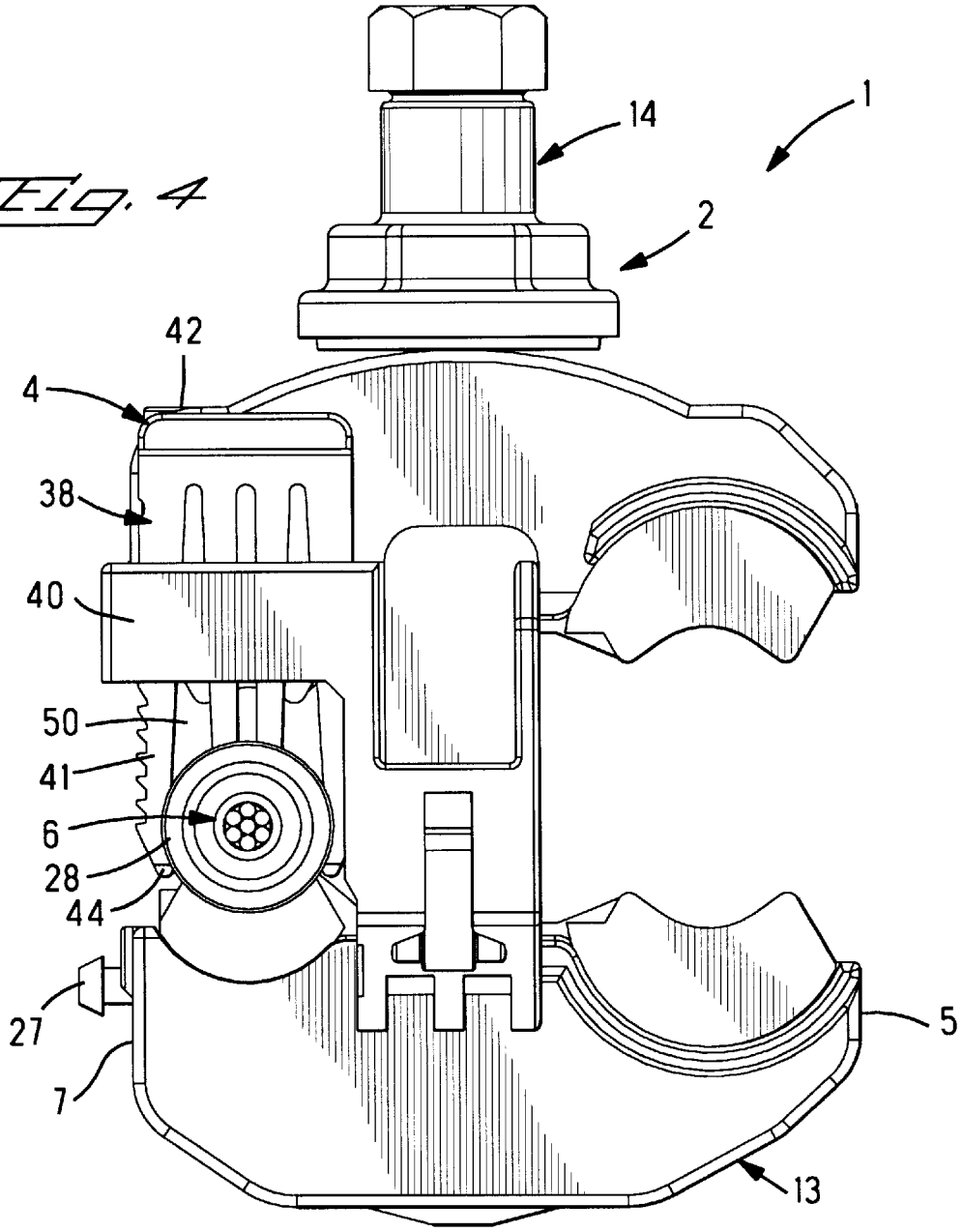
FIG. 4 is a plan end view of the assembly of FIG. 3.

As the cable 6 needs to be interconnected to another cable that is received on the first side 5 of the connector, it is advantageous to provisionally hold the connector and cable end together prior to tightening the bolt 14, which is effected by the retention members 4. Whilst two retention members are provided in the embodiment shown in FIGS. 2–4, one retention member 4 mounted to one of the connector jaws 11 at either end 34, 35 respectively thereof may be provided. The retention member 4 comprises a retainer plate 38 movably received through a guide 40 securely attached to a support 39 extending from one of the clamping jaws 13 of the connector. In this embodiment, the support 39 and guide 40 are integrally formed with the housing of the lower clamping jaw 13. The guide 40 has a cavity extending therethrough for guiding the retainer plate 38 in the direction of movement (V) thereof which is orthogonal to a plane formed by the cable direction (C) and direction of insertion (T) of the cable end into the connector. The retainer plate 38 is provided with a pair of flexible extensions 41 that extend from an actuation end 42 to a retaining end 44 of the plate, the ends 42, 44 at opposed ends of the retainer plate 38 with respect to the vertical direction (V) as viewed with respect to FIG. 1. Each extension 41 is provided with a plurality of teeth 46 on an outer edge thereof that are co-operable with teeth on respective inner edges of opposed sides of the guide 40 for retaining the retention plate 38 in the guide 40. In particular, the teeth 46 prevent the retaining plate 38 from being raised out of the retaining position shown in FIG. 3, which is achieved by depressing the retainer plate 38 (for example by manually pushing down the actuation end 42) until the opposed oblique clamping surfaces 48 of the retention end 44 clamp the cylindrical body portion 32 against the lower clamping jaw 13. The elasticity of the extensions 41 enable the retainer plate 38 to be depressed into the retaining position shown in FIG. 3 with the teeth 46 engaging co-operating teeth in the guide 40 like a ratchet.

The retention end 44 of each retainer plate 38 engages the sealing cap body 32 adjacent the respective retaining shoulders 30, 31 of the sealing cap in order to retain the end cable 6 and sealing cap 8 securely to the connector, particularly in the cable direction (C).

In view of the oblique (inwardly tapered and partially arcuate) surfaces 48 at the retention end 44, the sealing cap body 32 is tightly clamped against the end cable 6 at the locations of the retaining plates 38, particularly since the cap is made of a flexible material, thereby ensuring a secure grip of the end cable 6 to the assembly prior to termination. The cable 6 and sealing body 32 are "wedged" between the pair of resilient extensions 41.

It may be noted that the extensions 41 extend from the actuation end 42 substantially as cantilever beams provided with hollow portions 50 to increase the flexibility thereof whilst providing a robust extension with a sufficiently large clamping edge 48. The assembled end cable and sealing cap provisionally retained to the connector in the pretermination position shown in FIG. 3, can thus be handled by an operator for positioning another cable on the other side of the connector without concern about the need to position two cables simultaneously. This also ensures that when the bolt 14 is tightened and the clamping halves are moved together, the cables are correctly positioned between the insulation piercing contacts 9. The insulation piercing contact teeth of the connector are provided with a sufficient height to penetrate through the body 32 of the sealing cap and subsequently through the insulation of the cable for contacting the inner conductor core of the cable. As the body 32 of the sealing cap may be of a relatively thin compressible material, the insulation piercing teeth of standard connectors typically have a sufficient depth for piercing through the seal cap and insulating layer of the cable.

We claim:

1. An electrical connector assembly comprising an electrical insulation piercing connector having a pair of clamping jaws, at least one of the jaws comprising at least one insulation piercing terminal having insulation piercing contacts for piercing through an outer insulation layer of an electrical cable and contacting inner conducting strands thereof, the assembly further comprising an end sealing cap insertable over an end of the cable, wherein the end sealing cap is adapted to be received in a direction transverse to a direction of the cable between the clamping halves such that the insulation piercing contacts pierce through the end sealing cap during connection to the cable, and a guide securely fixed to one of the clamping laws and receiving a retaining plate that is movable from a cable receiving position where the sealing cap and end cable can be inserted between the jaws of the connector to a retaining position where the cable and sealing cap are retained and positioned against said one of the clamping jaws prior to termination of the cable.

2. The assembly of claim 1 wherein the retaining plate comprises at least one flexible extension having teeth along an outer edge thereof co-operable with complementary teeth in the guide for holding the retaining plate in cable receiving and cable retaining positions respectively.

3. The assembly of claim 1 wherein the connector comprises a pair of retention members positioned respectively adjacent opposed ends of the connector with regards to the cable direction.

4. The assembly of claim 1 wherein a plurality of end sealing caps for receiving cables of different diameters are integrally moulded together via break away bridging portions.

5. The assembly of claim 1 wherein the end sealing cap is provided with at least one retaining wall for locating the end sealing cap with respect to the connector in the cable direction.

6. The assembly of claim 5 wherein the sealing cap comprises at least a pair of said retaining walls separated by a distance for positioning proximate or adjacent respective opposed ends of the connector with regards to the cable direction.

7. The assembly of claim 6 wherein the sealing cap retaining walls are in the shape of discs extending radially from a cylindrical body portion of the sealing cap, thereby defining opposed retention shoulders respectively.

* * * * *